United States Patent [19]

Replogle

[11] 4,264,088

[45] Apr. 28, 1981

[54] SLIDE MOUNT FOR A SKI BINDING COMPONENT

[75] Inventor: Douglas L. Replogle, Amherst, N.Y.

[73] Assignee: Moog Inc., East Aurora, N.Y.

[21] Appl. No.: 9,141

[22] Filed: Feb. 5, 1979

[51] Int. Cl.[3] ..... A63C 9/10

[52] U.S. Cl. ..... 280/633; 280/618

[58] Field of Search ..... 280/618, 625, 633, 623, 280/616, 617, 11.37 E

[56] References Cited

U.S. PATENT DOCUMENTS

| | | | |
|---|---|---|---|
| 3,733,083 | 5/1973 | Berchtold | 280/633 |
| 3,807,748 | 4/1974 | Ramillon | 280/633 |
| 3,951,424 | 4/1976 | Napflin | 280/633 |

FOREIGN PATENT DOCUMENTS

| | | | |
|---|---|---|---|
| 2600858 | 12/1976 | Fed. Rep. of Germany | 280/618 |
| 2370490 | 6/1978 | France | 280/636 |

*Primary Examiner*—Robert J. Spar
*Assistant Examiner*—Kenneth Noland
*Attorney, Agent, or Firm*—Sommer & Sommer

[57] ABSTRACT

A slide mount is adapted to selectively move a plunger assembly of a ski binding relative to a detent recess component. The slide mount includes a rail mounted on the ski and having a channel aligned with the recess, a slide carrying the plunger assembly and mounted on the rail for sliding movement along the channel both toward and away from the recess, and an actuator arranged to act between the rail and slide to cause the slide to move between a first position closer to the detent recess and a second position farther from the detent recess. The actuator includes a lever pivotally mounted on the rail, and a link pivotally connected to the lever and the slide, so that pivotal movement of the lever will produce corresponding linear motion of the slide.

7 Claims, 7 Drawing Figures

Fig. 4.
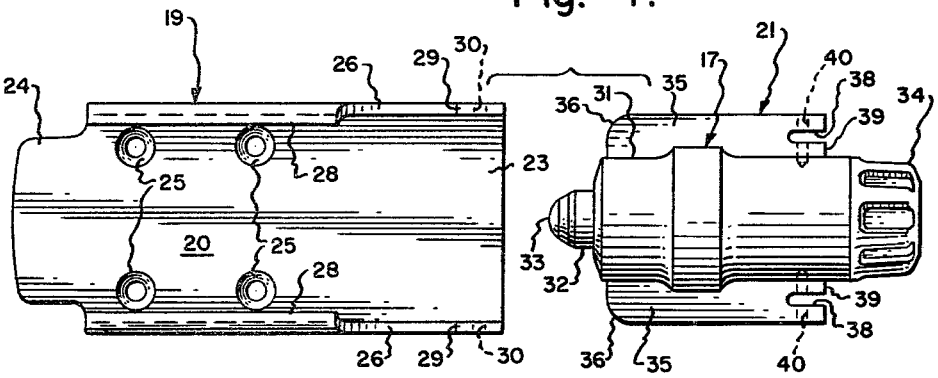
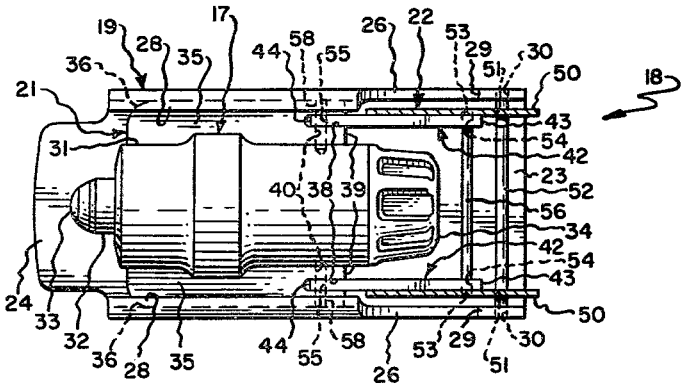
Fig. 5.
Fig. 6.
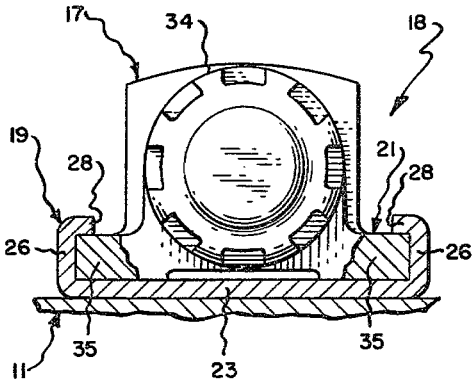
Fig. 7.
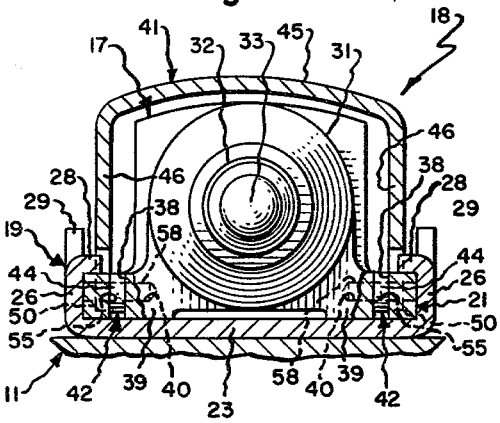

SLIDE MOUNT FOR A SKI BINDING COMPONENT

BACKGROUND OF THE INVENTION

1. Field of the Invention

The present invention relates generally to the field of ski bindings, and more particularly to an improved ski binding having means for moving a plunger assembly component relative to a component providing a detent recess.

2. Description of the Prior Art

Many types of ski bindings have, of course, been heretofore developed. One such type is disclosed and claimed in U.S. Pat. No. 3,921,995, which is assigned to the assignee of the present invention.

Recently, an improved pivot clip has been developed for use in association with the binding disclosed in said U.S. Pat. No. 3,921,995. This improved pivot clip, which is fully disclosed and claimed in pending U.S. patent application Ser. No. 937,168, filed Aug. 28, 1978, now U.S. Pat. No. 4,192,527 and also assigned to the assignee of the present invention, has permitted the use of stiffer springs in the plunger assembly without producing a concomitant rise of the torque needed to effect a torsional release of the "boot assembly" from the ski.

The use of stiffer springs in a ski binding plunger has made it more difficult for a skier to "snap" the sole-plate back into engagement with the binding. At the same time, persons skilled in this art have begun to realize that ski bending is a significant factor to be considered in the binding design. For example, in said U.S. Pat. No. 3,921,995, the sole-plate is engaged and held to the ski by forces exerted at each of three mutually-spaced locations arranged at the apices of an imaginary isosceles triangle. If, while skiing, the tips and tail of the ski bend downwardly, such that the ski's lower surface is concave, this has the effect of increasing the spacing between at least two of the locations at which the forces are exerted on the sole-plate. Normally, this change in spacing is accommodated by corresponding movement of the plunger. However, if the plunger assembly employs a coil spring having linear force-to-displacement characteristics, the additional plunger displacement needed to compensate for ski bending has the practical effect of reducing the force by which the sole-plate is held to the ski.

SUMMARY OF THE INVENTION

The present invention provides an improvement for a resiliently-loaded ski binding wherein a boot assembly is releasably secured to a ski by loading means which includes a plunger assembly component on one of the ski and boot assembly engageable with a detent recess component on the other of the ski and boot assembly.

The improvement provides a slide mount for selectively moving one component relative to the other, and broadly includes: a rail mounted on one of the boot assembly and ski and having a channel aligned with one of the components; a slide carrying the other component and operatively mounted on the rail for movement along the channel toward and away from the one component, and an actuator arranged to act between the rail and slide and selectively operable to move the slide between a first position closer to the one component, and a second position farther from the one component.

In the preferred embodiment, the rail is mounted on the ski, the plunger assembly component is mounted on the slide, and the detent recess component is mounted on the boot assembly.

The actuator may include a lever pivotally mounted on either the rail or slide and adapted to be moved between a raised position and a lowered position, and at least one link having one marginal end portion pivotally connected to the lever and having another marginal end portion pivotally connected to the other of the rail and slide. Desirably, the link should be substantially parallel to the longitudinal axis of the ski when the lever is in the lowered position. In the preferred embodiment, the lever is pivotally mounted on the rail.

Accordingly, one general object of the invention is to provide an improved ski binding.

Another object is to provide an improved ski binding which includes a slide mount for selectively moving a plunger assembly component relative to a detent recess component.

Another object is to provide an improved ski binding which facilitates re-entry of a sole-plate despite the use of stiffer plunger springs.

Another object is to provide an improved ski binding which may displace a plunger assembly relative to a detent recess to sufficiently load the plunger spring to accommodate bending of the ski while skiing.

These and other objects and advantages will become apparent from the foregoing and ongoing written specification, the drawings, and the appended claims.

BRIEF DESCRIPTION OF THE DRAWINGS

FIG. 4 is an exploded top plan view thereof, showing the slide aligned with the rail channel prior to insertion.

FIG. 5 is a fragmentary horizontal sectional view thereof, taken generally on line 5—5 of FIG. 3.

FIG. 6 is a fragmentary transverse vertical sectional view thereof, taken generally on line 6—6 of FIG. 3.

FIG. 7 is a fragmentary transverse vertical sectional view thereof, taken generally on line 7—7 of FIG. 3.

DESCRIPTION OF THE PREFERRED EMBODIMENT(S)

Figure 1:
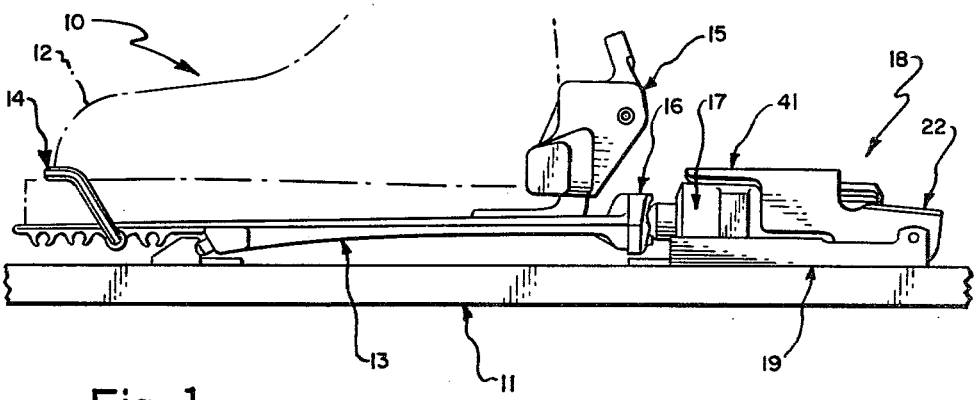
FIG. 1 is a fragmentary side elevation of a ski binding incorporating the improved slide mount.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now to the several drawing figures, and more particularly to FIG. 1 thereof, the present invention provides a unique improvement in a resiliently-loaded ski binding, generally indicated at 10.

In FIG. 1, ski binding 10 is shown as being generally the type disclosed in U.S. Pat. No. 3,921,995, the aggregate disclosure of which is hereby incorporated by reference. This ski binding 10 is adapted for use in releasably securing a "boot assembly" to a ski 11. As used herein, the term "boot assembly" is intended to refer to that structure which remains with the skier when the skier falls and separates from the ski. Hence, in the disclosed binding, the term "boot assembly" includes the skier's boot 12, the sole-plate 13, a toe loop 14, and a step-in heel engaging mechanism 15. However, the improvement may be used with a conventional type of binding, in which case the term "boot assembly" refers generally to the skier's boot. Additional details of the disclosed binding are shown in said U.S. Pat. No. 3,921,995.

The disclosed binding 10 is further shown as including a component 16 at the rear of the sole-plate which includes a suitable rearwardly-facing detent recess (not shown), and a plunger assembly component 17 mounted on the ski and arranged to engage and exert a force on this detent recess component so as to releasably hold the sole-plate to the ski. Inasmuch as this force is exerted by a compressed spring within the plunger assembly, the binding is resiliently loaded.

Still referring principally to FIG. 1, the improvement provides a slide mount, of which the presently preferred embodiment is generally indicated at 18, for selectively moving the plunger assembly component 17 relative to the detent recess component 16.

Figure 2:
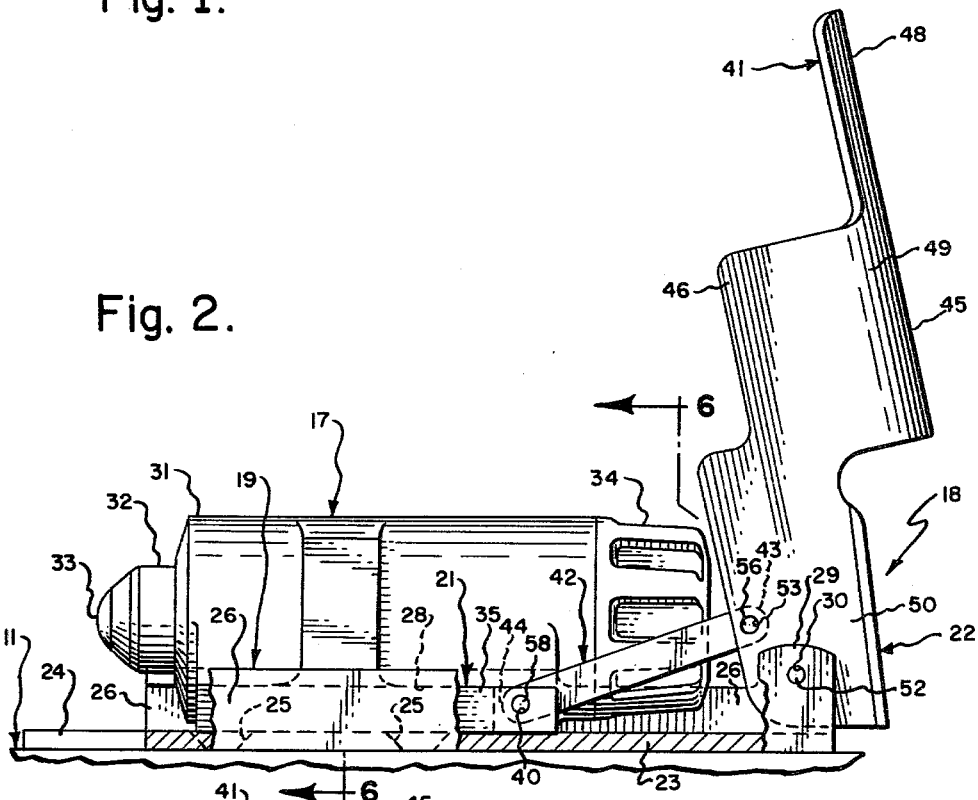
FIG. 2 is an enlarged fragmentary side elevation of the improved slide mount, this view showing the lever in its raised position and having portions of the rail broken away to expose details of the slide.
Figure 3:
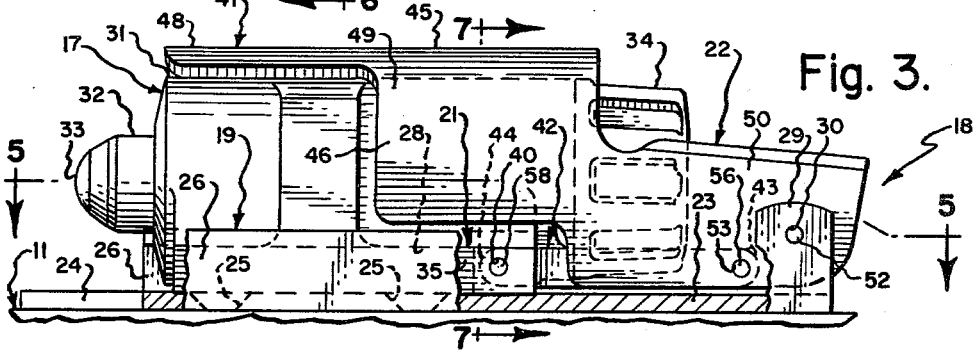
FIG. 3 is a view similar to FIG. 2, but showing the lever as having been moved to its lowered position.

Referring now to FIGS. 2–7, the improved slide mount 18 is shown as broadly including: a rail, generally indicated at 19, mounted on the ski and having a channel 20 (FIG. 4) aligned with the detent recess; a slide, generally indicated at 21, carrying the plunger assembly component and operatively mounted on the rail for movement along the channel relative to the detent recess component; and an actuator, generally indicated at 22, arranged to act between the rail and slide and selectively operable to move the slide between a first position closer to the detent recess component (as shown in FIG. 3), and a second position farther from the detent recess component (as shown in FIG. 2).

As best shown in FIGS. 2–4, 6 and 7, the rail 19 is mounted on the ski and may be conveniently stamped from suitable cold rolled low carbon steel sheet stock. In FIG. 4, the rail is shown as having a rectangular planar horizontal bottom portion 23 from which a tongue 24 extends forwardly (leftwardly in FIG. 4). Four rectangularly-spaced countersunk mounting holes, severally indicated at 25, are provided through rail bottom portion 23 to accommodate passage of a plurality of fasteners (not shown) by which the rail may be secured to the ski. As best shown in FIGS. 6 and 7, a web portion 26 rises vertically upwardly from the lateral margins of rail bottom portion 23. Adjacent its forward end, these webs are provided with in-turned horizontal flange portions 28, 28 to define channel 20 which is aligned with the detent recess component. Adjacent the rail's rearward end (rightwardly in FIG. 4), the webs 26, 26 have portions 29, 29 which continue upwardly and which are provided with aligned horizontal through holes 30, 30 for a purpose hereinafter apparent.

The slide 21 is shown as being formed integrally with the body 31 of plunger assembly component 17. By itself, the plunger assembly component 17 includes body 31, a plunger 32 movable horizontally relative to the housing and having a forwardmost convex nose 33 adapted to engage the detent recess, a suitable spring (not shown) or resilient member (not shown) arranged within the plunger body to urge the plunger to move forwardly (leftwardly in FIG. 4) toward the detent recess, and a rearward end cap 34 which may be removed to afford access to the plunger housing. In the preferred embodiment, the slide includes a pair of elongated plate-like rectangular flanges 35, 35 which extend laterally outwardly from a lower portion of plunger housing 31. As best shown in FIGS. 6 and 7, the outer margins of these slide flanges 35, 35 are captured by the rail channel, specifically between the rail's bottom 23, webs 26, 26 and inturned flanges 28, 28. Hence, the slide is operatively mounted on the rail for sliding movement along the longitudinal axis of rail channel 20. As best shown in FIG. 4, the forward outward edges of these slide flanges 35, 35 are rounded at 36 to facilitate insertion of the slide into the rail channel. Rectangular vertical slots 38, 38 are shown as extending forwardly into slide flanges 35, 35 from their rearward surfaces 39, 39. Horizontal holes 40, 40 are drilled transversely into the slides so as to intersect slots 38, 38, as best shown in FIG. 4. While the slide is formed integrally with the plunger housing 31 in the preferred embodiment, persons skilled in this art will appreciate that the slide and plunger assembly may alternatively be formed as separate subassemblies and thereafter assembled together.

Referring now to FIGS. 2, 3, 5 and 7, the actuator 22 is shown as including a lever, generally indicated at 41, pivotally mounted on the rail and adapted to be moved between a raised position (FIG. 2) and a lowered position (FIG. 3), and at least one link 42 having one marginal end portion 43 pivotally connected to the lever and having another marginal end portion 44 pivotally connected to the slide. Thus, movement of the lever 41 between its raised and lowered positions will produce corresponding movement of the slide between its second and first positions.

The lever 41 is shown as being a specially-configured member which is adapted to partially surround the plunger housing when the lever is in its lowered position. When viewed in transverse cross-section (FIG. 7), lever 41 appears to have a central rounded upper portion 45 from which two transversely-spaced planar vertical plates 46, 46 depend. When viewed in side elevation (FIG. 2), the lever is seen as having a distal handle portion 48 formed from lever rounded portion 45, an intermediate transitional portion 49 formed from the lever upper and plate portions, and two tranversely-spaced leg portions 50, 50 formed from the lever plate portions. Adjacent their rearward ends, legs 50, 50 are provided with aligned holes 51, 51. As best shown in FIG. 5, a pivot pin or shaft 52 is arranged to pass through lever holes 51, 51 and rail holes 30, 30. Of course, this pivot pin 52 may be retained in this position by any suitable means. Hence, lever 41 is mounted on the rail for pivotal movement between the raised position shown in FIG. 2, and the lowered position shown in FIG. 3. Lever leg portions 50, 50 are shown as being further provided with another pair of aligned holes 53, 53 for a purpose hereinafter explained.

The preferred embodiment is shown as including two of links 42 operatively connecting the lever to the slide. Each link 42 is shown as being an elongated vertical plate-like member provided with a hole 54 through its rightward marginal end portion 43, and also provided with another hole 55 through its leftward marginal end portion 44. As best shown in FIG. 5, a pivot pin or shaft 56 is arranged to penetrate link rear holes 54, 54 and lever holes 53, 53 to pivotally connect the link first marginal end portions 43, 43 to the lever. Of course, this pivot pin 56 may be retained in this position by any suitable means. Still referring principally to FIG. 5, another pivot pin 58 is arranged in each slide hole 40 and penetrating a link forward hole 55 to pivotally connect each link second marginal end portion 44 to the slide. Again, these pivot pins 58, 58 may be retained in these positions by any suitable means. Hence, each link 42 has one marginal end portion 43 pivotally connected to the lever and has another marginal end portion 44 pivotally connected to the slide.

When the lever is in its raised position (FIG. 2), the slide will be in its retracted or second position. Conversely, when the lever has been moved to its lowered position (FIG. 3), the slide will be in its forward or extended position. Moreover, it should be noted that lever holes 53, 53 are located at positions such that when the lever is in its lowered position, the links 42, 42 will be substantially horizontal and parallel to the longitudinal axis of the ski so that a rearward reaction force exerted by the detent recess component on the plunger and slide will not transmit any vertical force component which might tend to move the lever to its raised position. If desired, the location of lever holes 53, 53 could be designed such that the link would be in a "over center" position when the lever was moved to its lowered position, so that any such reaction force would have a downwardly-acting component which would tend to hold the lever in its lowered position.

In the preferred embodiment, the rail is shown as being mounted on the ski. However, the invention contemplates that on an alternative design, it might be desired to position the rail on the boot assembly. Likewise, the lever may be pivotally mounted on the slide, if desired. Moreover, the positions of the detent recess and plunger assembly componenents may be reversed or otherwise varied, as desired. Indeed, the detent recess and plunger assembly are only two possible "components" of the binding. The cross-sectional shape of the channel is considered to be a matter of design choice, and may readily be varied. For example, a dovetail-type connection could be provided between the rail and slide.

Therefore, while the preferred embodiment of the present invention has been shown and described, and several modifications thereof discussed, persons skilled in this art will appreciate that various additional changes and modifications may be made without departing from the spirit of the invention which is defined by the following claims.

What is claimed is:

1. In a resiliently-loaded ski binding wherein a boot assembly is releasably secured to a ski by loading means including a first component engageable with a second component, the improvement which comprises: a slide mount for selectively moving one of said components relative to the other of said components, said slide mount including a rail mounted on one of said boot assembly and ski and having a channel aligned with one of said components;

a slide carrying the other of said components and operatively mounted on said rail for movement along said channel relative to said one component; and an actuator arranged to act between said rail and slide and selectively operable to move said slide between a first position closer to said one component and a second position farther from said one component, said actuator including a lever pivotally mounted on one of said rail and slide and adapted to be moved between a raised position and a lowered position and including at least one link having one marginal end portion pivotally connected to said lever and having another marginal end portion pivotally connected to the other of said rail and slide, and wherein the longitudinal axis of each link is substantially parallel to the longitudinal axis of said ski when said lever is in said lowered position.

2. The improvement as set forth in claim 1 wherein said first component is mounted on said slide.

3. The improvement as set forth in claim 2 wherein said slide is formed integrally with a part of said first component.

4. The improvement as set forth in claim 1 wherein said rail is mounted on said ski.

5. The improvement as set forth in claim 1 wherein said lever is pivotally mounted on said rail.

6. The improvement as set forth in claim 1 wherein said actuator has a variable mechanical advantage.

7. The improvement as set forth in claim 1 wherein the mechanical advantage of said lever increases as said lever is moved toward said lowered position.

* * * * *